US010899519B2

(12) United States Patent
Este et al.

(10) Patent No.: US 10,899,519 B2
(45) Date of Patent: Jan. 26, 2021

(54) SUPPORT FOR A PRODUCT PACKAGED IN UNIT DOSES, AND METHOD FOR THE PRODUCTION THEREOF

(71) Applicants: Flavio Este, Selvazzano Dentro (IT); Lorenzo Spagna, Guastalla (IT)

(72) Inventors: Flavio Este, Selvazzano Dentro (IT); Lorenzo Spagna, Guastalla (IT)

( * ) Notice: Subject to any disclaimer, the term of this patent is extended or adjusted under 35 U.S.C. 154(b) by 0 days.

(21) Appl. No.: 15/736,214

(22) PCT Filed: Jun. 16, 2016

(86) PCT No.: PCT/IB2016/053570
§ 371 (c)(1),
(2) Date: Dec. 13, 2017

(87) PCT Pub. No.: WO2016/203418
PCT Pub. Date: Dec. 22, 2016

(65) Prior Publication Data

US 2018/0170640 A1 Jun. 21, 2018

(30) Foreign Application Priority Data

Jun. 19, 2015 (IT) ..... 102015000025752

(51) Int. Cl.
*B65D 73/00* (2006.01)
*A47F 5/00* (2006.01)
*A61J 1/03* (2006.01)

(52) U.S. Cl.
CPC ..... *B65D 73/0092* (2013.01); *A47F 5/0006* (2013.01); *A61J 1/035* (2013.01)

(58) Field of Classification Search
CPC ..... B65D 73/0092; B65D 75/326; B65D 75/366; B65D 2585/56; B65D 51/2821;
(Continued)

(56) References Cited

U.S. PATENT DOCUMENTS 1,816,542 A * 7/1931 Mellin ..... B65D 73/0092 206/463
3,246,747 A * 4/1966 Blish ..... B65D 73/0092 206/462
(Continued)

FOREIGN PATENT DOCUMENTS

DE 10 2007 015 090 A1 10/2008
EP 1 346 929 A1 9/2003
(Continued)

OTHER PUBLICATIONS

International Search Report issued in PCT/IB2016/053570, dated Sep. 27, 2016 (4 pages).
(Continued)

*Primary Examiner* — Bryon P Gehman
(74) *Attorney, Agent, or Firm* — Flynn Thiel, P.C.

(57) ABSTRACT

A support for a unit dose including a support card having a flap folded over and fastened to a main portion thereof. A main opening is made in the main portion, from which opening there protrudes a portion of a pack of a unit dose product. At least part of a peripheral edge of the pack is enclosed between the flap and the main portion of the support card. An opening or notch or pre-cut is made in the flap, to allow the unit dose product to be removed from its pack.

10 Claims, 5 Drawing Sheets

(58) Field of Classification Search
CPC ... B65D 75/36; B65D 2575/00; A47F 5/0006; A61J 1/035; A61J 1/03
USPC ..... 206/530, 462, 463, 495, 806; 40/124.11, 40/124.12, 124.14
See application file for complete search history.

(56) References Cited

U.S. PATENT DOCUMENTS

| | | | | |
|---|---|---|---|---|
| 3,248,842 | A * | 5/1966 | Peppler | B65D 75/305 206/462 |
| 4,083,451 | A * | 4/1978 | Hair | B29C 65/02 206/461 |
| 4,826,211 | A * | 5/1989 | Sinnott | A63F 3/0665 229/92.8 |
| 4,870,764 | A * | 10/1989 | Boone | G09F 1/04 40/124.06 |
| 5,257,823 | A * | 11/1993 | Colvin, Jr. | G09F 1/00 40/124.06 |
| 5,878,885 | A * | 3/1999 | Wangu | B65D 75/326 206/461 |
| 6,230,964 | B1 * | 5/2001 | Saito | B65D 75/22 206/462 |
| 6,308,832 | B1 | 10/2001 | Pirro et al. | |
| 7,959,005 | B2 | 6/2011 | Berg et al. | |
| 2006/0042987 | A1 | 3/2006 | Buss | |
| 2007/0235367 | A1 | 10/2007 | Initini | |
| 2008/0060968 | A1 * | 3/2008 | Levy | B65D 73/0078 206/531 |
| 2010/0140132 | A1 | 6/2010 | Berg et al. | |
| 2010/0243507 | A1 | 9/2010 | Gelardi et al. | |
| 2015/0122692 | A1 * | 5/2015 | Kavuru | A61J 1/035 206/530 |

FOREIGN PATENT DOCUMENTS

| | | | |
|---|---|---|---|
| EP | 1 346 931 | A1 | 9/2003 |
| EP | 1 560 756 | A1 | 8/2005 |
| EP | 2 603 435 | A1 | 6/2013 |
| WO | WO 99/65787 | A1 | 12/1999 |
| WO | WO 2004/033306 | A1 | 4/2004 |
| WO | WO 2012/020354 | A1 | 2/2012 |
| WO | WO 2014/207507 | A1 | 12/2014 |

OTHER PUBLICATIONS

Written Opinion of the International Searching Authority issued in PCT/IB2016/053570, dated Sep. 27, 2016 (4 pages).
Singapore Written Opinion issued in corresponding Application No. 11201710387T, dated Dec. 16, 2019 (5 pages).

* cited by examiner

SUPPORT FOR A PRODUCT PACKAGED IN UNIT DOSES, AND METHOD FOR THE PRODUCTION THEREOF

The present invention relates to the sector of the automated management of products packaged in unit doses. The invention was developed with particular regard, although not exclusively, to pharmaceutical products and the like, distributed by pharmacies in unit doses for administration to patients on the basis of medical prescriptions.

Drugs and similar products are administered in unit doses, on the basis of medical prescriptions that precisely set out the quantities and the administration frequency. These products are packaged in sealed packs that are opened only at the time of administration. For drugs such as pills, lozenges, capsules and the like, it is very common to use blister packs, in which each drug dose is individually enclosed in a blister of pliable, often transparent material, which is sealed by a sheet of pliable material such as card or, more frequently, aluminium. Other pharmaceutical products, such as suppositories or many powdered or liquid products, are contained in sealed packets formed of two sheets of juxtaposed material sealed along a common peripheral edge. Individual doses of drugs in blister packs are extracted by pressing on the drug by action on the blister containing said drug, so as to break the sheet of pliable material. Packets, on the other hand, are opened by tearing off a strip thereof, sometimes from a specific position on the peripheral edge on which a starting cut has been made beforehand.

The blister packs normally supplied by pharmaceutical companies comprise several doses of pharmaceutical products on a common substrate, each contained in a particular blister. For optimal management, particularly in hospital pharmacies, these blister packs are cut up into individual items, so as to produce unit dose blister packs, for example by using one of the systems described in EP 1560756 or EP 2603435 from the present applicant.

Unit dose packs are very convenient for automating prescriptions in a hospital environment, and constitute a notable improvement to ensure that patients take the correct drugs, in the quantities and by the methods prescribed. However, because of their small size and the large quantities of unit dose products to be managed, automated management systems have to use special expedients to ensure that storage and handling are easy, simple, tested and safe.

There are various known systems for storing and dispensing unit dose products, which are particularly useful and advantageous when used in a hospital environment. One such system, developed by the present applicant and described in EP 1346929, comprises a store produced so as to automatically manage the quantities of drugs stored, requests for supply, and the shelf lives of each drug stored.

In the prior art system described in EP 1346929, drugs are packaged in unit doses, and each pack is placed inside a sachet on which are printed details relating to the specific drug, such as its commercial name, the active ingredient, the production batch, and the expiry date, both as text and as a bar code. The sachets containing the unit dose drugs are hung from pegs in the store, ready to be picked following prescription by the hospital medical staff. For distribution to the various hospital departments, the sachets containing the unit dose drugs of the same medical prescription are combined together by means of a loop tie, as described in EP 1346931 from the same applicant. Each loop is made up of the prescribed drugs, in chronological order of administration, and is provided with a label containing all the details of the patient for whom it is intended.

The known system discussed briefly above has resolved notable problems in managing unit dose drugs within the context of hospital facilities, where it has proved efficient and valued. The present applicant has, however, considered that the system for managing the unit dose drug should be developed further to improve its characteristics and to make it even more advantageous, particularly in terms of greater efficiency and reliability, as well as lower cost, both as regards its installation and ordinary management operations.

The applicant has, in fact, noted in its years of experience accumulated by developing and supplying the system described above, that the packaging of unit dose drugs in sachets to be hung from pegs presents some difficulties owing to the need to handle a substantially floppy object, which is produced initially from a band or the like by welding operations, and then has to be kept open at one of its ends in order to introduce the unit dose of drug, is then sealed closed, and subsequently handled during all the phases of storage, picking, grouping and delivery of the unit dose drugs to the hospital departments. Furthermore, indicating the information about the specific drug on the sachet is an operation that is not easy to achieve.

To overcome the difficulties mentioned above and to improve the system for managing the unit dose drug, the present applicant has developed a support for a unit dose drug, described in WO 2014/207507, which comprises a relatively rigid support card having a hole or slot within which the blister of a blister pack of a unit dose drug is provided. The edge of the blister pack of the unit dose drug is glued directly to the support card, or is fastened thereto by means of adhesive film.

The object of the present invention is to produce an improved support for a unit dose drug, that is simple and economical and whose production can easily be automated. Another object of the invention is to produce a support for a unit dose drug that can house both blister packs in various shapes and also different types of packs, for example single-dose sachets for powdered or liquid drugs, metallised packets for suppositories and the like, and so on.

In order to achieve the above-mentioned objects, the invention relates to a support for a product packaged in unit doses, as well as to a method for the production thereof, as defined in the following claims.

According to a first aspect, a support for a product packaged in unit doses comprises a support card, which has a flap folded over and fastened to a main portion thereof. A main opening is made therein, from which a portion of a pack of a unit dose product appears. At least part of a peripheral edge of the pack is enclosed between the flap and the main portion of the support card. An opening is made in the flap to allow the unit dose product to be removed from its pack. An opening in the flap can also be used for housing packs that are relatively bulkier than a blister pack, such as a sachet for suppositories or the like. The production of a single card made of preferably flexible material that is folded in two so as to enclose a pack of a unit dose product constitutes a notable simplification and a cost saving compared with using sachets as in the prior art. Moreover, the solution described makes it possible to connect the pack of the unit dose product to the support without it being necessary to fasten it directly thereto. This results in greater simplicity of handling small unit dose packs. Moreover, there is no risk of adversely affecting the unit dose products by bringing welding or gluing systems too close to the pack as in the prior art.

Preferably, an opening that is the same as the main opening is made in the flap of the support card. This makes it possible to have an opening for removing the product that substantially corresponds to the width of the mouth of the blister of a blister pack that is housed in the main opening.

This makes it easier to remove the product from the blister pack.

According to a variant, the main opening is a transversely elongated slot in the support card. An opening like this makes it possible to house packs of unit dose products of various shapes, for example having an elongated shape such as a blister pack for a pill, or a rounded shape such as a blister pack for a tablet. This may simplify production of the support, since simple, standardised cutting equipment can be provided for a large number of packs of unit dose products.

According to another variant, the main opening is a circular hole. Since the hole can be made to be only slightly bigger than a blister of a blister pack, it is possible to produce a support for a unit dose product, in which the pack is hardly able to move, ensuring safety in the subsequent steps of handling the support.

According to a variant, the main opening extends into the flap so as to form an identical aperture. This makes it possible to produce a particularly useful support for sachets or packs that are opened by tearing off the edge thereof. In fact, by providing a single aperture, a support is produced in the folded flap that exposes on the folded side a portion of the edge of the sachet, which is then convenient to open.

According to another aspect, the support for the product packaged in a unit dose is produced in such a way that, instead of an actual opening, a notch or pre-cut incision is made in the flap of the support card. This makes it possible to produce a flap that remains sealed during storage and handling of the support, and can nevertheless be opened easily at least in one of its portions in order to remove the unit dose product from its pack at the time of use.

Preferably, the flap is fastened to the main portion on at least three sides. The fourth side, corresponding to the side of the flap that folds over on the main portion of the support card, can be unfastened. This simplifies the operations of assembling the support. In all cases, at least three fastening sides ensure that the product in a unitary pack, even if not directly fastened to the support card, does not separate therefrom.

Preferably, the flap is fastened to the main portion by welding with no added material. The operation is simple and safe, and makes it possible to keep the drug intact inside the unit dose pack.

According to a particular aspect, a further opening or hole is made in the support card for hanging the support, for example in a store provided with pegs.

According to a particular aspect, the support card is substantially rectangular, and the flap is folded over the main portion along a fold line that is substantially transverse to the long side of the support card. This shape proves compact, simple to handle and produce, and convenient to store.

According to another aspect, a method is described for producing a support for a product packaged in unit doses, comprising the steps of:

providing at least one support card having a main portion in which a main opening is made, and a flap that can be folded over the main portion in which an opening or notch or pre-cut is made, which is centred symmetrically so as to be equidistant from the centre of the main opening relative to a line for folding the flap over the main portion;

housing the pack of a unit dose product in the main opening in the main portion of the card, so that a portion thereof appears from the main opening and a peripheral edge thereof rests at least in part on the main portion of the support card;

folding the flap along the fold line until it is brought over the main portion so as to enclose at least part of the peripheral edge between the flap and the main portion of the support card; and fastening the flap to the main portion of the support card.

Preferably, the flap is fastened to the main portion by welding with no added material. The welding is done in a zone relatively far away from the product packaged in a unit dose, so as to avoid impairing the characteristics and intactness of the product itself, particularly in the case of a pharmaceutical product. Welding is preferably of the ultrasonic type, so as to prevent any heating of the material of the support strip as far as possible.

Preferably, the support card is produced by cutting it or shearing it from a band of material. This system proves simple and economical, and easy to automate.

Further features and advantages will become apparent from the following detailed description of some preferred embodiments of the invention, given purely by way of non-restrictive example, with reference to the attached drawings, in which:

FIGS. 7A and 7B to 13A and 13B illustrate diagrammatically other variants of a support for a unit dose according to the present invention, respectively in configurations before and after their assembly.

In the present description, the term "card" is used for identifying the support structure to which the product packaged in unit doses is connected. The term "card" must not, however, be understood in restrictive terms that limit its shape or material or other features thereof. The term "card" should, however, be understood as a summarising expression since the support structure has a relatively small thickness compared with the other two dimensions, and since the combination of this small thickness and the material used to produce the support structure, i.e. the "card", make it possible—with the aid of a zone of weakened material if necessary—to fold one portion thereof over another, as will be described more clearly below.

Figure 1:
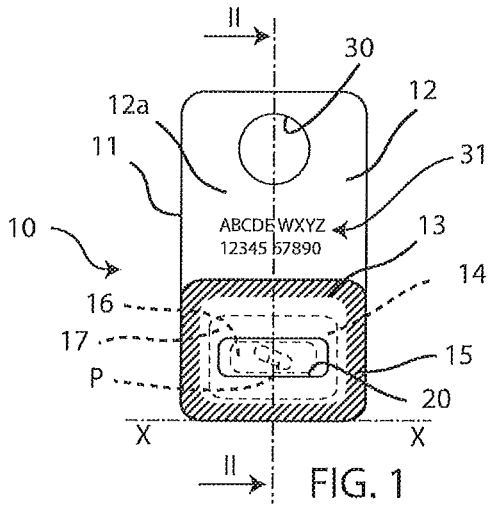
FIG. 1 is a front view of a first example of a support for a unit dose product according to the invention, in the assembled configuration.
Figure 2:
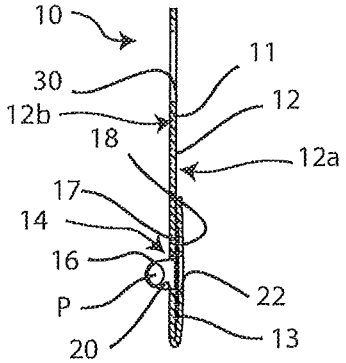
FIG. 2 is a section along the line II-II in FIG. 1.
Figure 3:
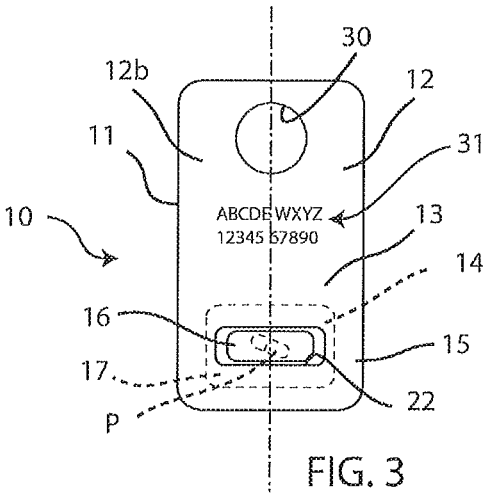
FIG. 3 is a rear view of the example of a support in FIG. 1, in the direction of the arrow III in FIG. 2.

With reference now to FIGS. 1 to 3, a support 10 for a unit dose product comprises a card 11, for example a sheet of cardboard or laminated paper, a layer of plastic material, a slim metal plate or similar, having a main portion 12 and a flap 13 folded along a fold line X-X, corresponding to one edge of the support 10 in the assembled configuration shown in the figures. The flap 13 is only partly superimposed on the main portion 12 and is fastened thereto along part or all of a peripheral edge zone 15, indicated conventionally by hatching in FIG. 1. Depending on the material of the card 11 and/or the production technology used, fastening can be done by welding or gluing, or by means of mechanical fastening using staples or the like. Preferably, but not restrictively, the material of the card 11 is a plastics material and the flap 13 is joined to the main portion 12 by ultrasonic welding. Ultrasonic welding prevents generalised heating of the material and therefore does not alter the characteristics of the unit dose product, which is particularly advantageous in the case of a drug. Ultrasonic welding also proves convenient with respect to gluing because no additional material is involved. In some cases, depending on the rigidity of the material of the card 11 and on the particular type of fold made in order to bring the flap 13 over the main portion 12, it is not necessary to fasten the edge along the fold line X.

A hole 30 can be made in the main portion 12 of the card 11, which hole is useful for hanging the support for a unit dose product 10, for example in the store with pegs described in EP 1346929 from the same applicant. On the main portion 12 of the card 11, for example in the zone of its face 12*a* left free by the flap 13 and/or on the other face 12*b*, opposite that to which the flap 13 is fastened, it is possible to add information 31 for identifying the unit dose product. The information 31 can be added by writing directly on the main portion 12, for example by printing or engraving, or by other known means, or by fastening a label or other pre-printed item to the main portion 12. The information 31 can also be stored on an RFID tag or other similar components to be fastened to the main portion 12 of the card 11. The information 31 can be represented in any known manner, either as plain text or using a bar code, QR code or the like.

A blister pack 14 of a unit dose product is held between the main portion 12 and the flap 13 of the card 11. As will be seen more clearly below, the invention is not limited to the support for unit dose products contained in blister packs, but can advantageously also be adapted for use with unit dose products in different packs, such as sachets or packets, of the type generally used in the sector of unit dose products of the pharmaceutical type.

The blister pack 14 comprises a blister 16, inside which a unit dose product P is housed, for example a pill or a tablet of a drug. The blister 16, generally made of plastics material, comprises a peripheral edge 17 and is sealed by a film 18, usually made of metal or paper, welded to the peripheral edge 17. As is known, by pressing on the blister 16, it is possible to remove the unit dose product P as necessary from the blister pack 14, breaking the film 18.

A main opening 20 is made in the main portion 12 of the card 11, into which opening the blister 16 of the blister pack 14 is inserted. The dimensions of the main opening 20 are such that the blister 16 can protrude from the main portion 12 of the card 11, from the part opposite the flap 13, while the peripheral edge 17 of the blister pack 14 is, at least in part, wider than the main opening 20 such that it remains positioned between the main portion 12 and the flap 13 superimposed thereon and fastened thereto.

A secondary opening 22 is made in the flap 13, which secondary opening is substantially centred relative to the main opening 20. It is possible to remove the product P through the secondary opening 22 when the blister 16 of the blister pack 14 is squeezed during use.

The main opening 20 shown in the non-restrictive example in FIGS. 1 to 3 is substantially rectangular in shape, with rounded corners, or generally elongated and slot-shaped. The long side of the main opening is positioned transversely to the width of the card 11. The secondary opening 22 in this example is the same size as the main opening 20 and is completely superimposed thereon. The main opening 20, which is elongated and slot-shaped, can conveniently accommodate the blister 16 of a blister pack 14 of corresponding shape, of the type used for example for packaging pills of elongated shape, such as the pill P shown in the example in FIGS. 1 to 3. The corresponding shape of the secondary opening 22 then makes it possible to remove the pill P conveniently from the blister 16, without the user noticing any significant difference from removing a pill from an ordinary type of blister pack. In fact, the film 18 that seals the blister 16 can be broken without difficulty after pressure is exerted on the pill P when squeezing the blister 16, and the pill P can easily come out of the blister pack 14 because the width of the secondary opening 22 corresponds substantially to the width of the mouth of the blister 16. Furthermore, the card 11 is fairly slim and therefore does not pose an obstacle to removing the pill P.

The card 11 is preferably made of a flexible, but nonetheless not too soft or yielding, material. In this way it is possible to produce a reaction on the card 11 in order to remove the unit dose product from the blister pack, so as to compensate for the difficulty of using just the peripheral edge 17, which is generally small. In this respect, the present invention resolves a problem of the prior art, in which the unit dose products are inserted into sachets, which serve only for storing the products.

When, as in the example in FIGS. 1 to 3, the secondary opening 22 is large and corresponds substantially to the size of the mouth of the blister 16 of the blister pack 14, it is possible to read, through the same, at least part of the information usually printed on the film 18 that seals the blister 16. It is thereby possible to inspect the unit dose product associated with the support 10. Even more preferably, the material of the card 11 is transparent so that, irrespective of the size of the secondary opening 22, the information printed on the film 18 of the blister pack 14 can be read through the flap 13.

The shape of the main opening 20, elongated in the shape of a slot or rectangular with rounded corners, or more generally oblong, as illustrated in FIGS. 1 to 3, can advantageously also be used in association with blister packs other than oblong ones. In other words, the size and shape of the main opening 20 are not necessarily linked to the shape of the blister of the unit dose blister pack, even though—as will be demonstrated below—it is possible and advantageous to produce a production line, even on an industrial scale, in which the main opening 20 and/or the secondary opening 22 differ from product to product.

Figure 4:
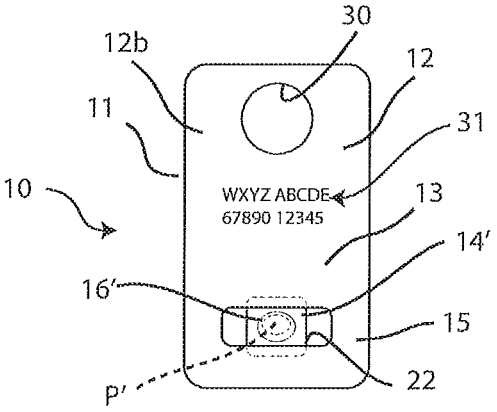
FIG. 4 is a rear view of the example of a support in the previous figures, assembled with a different unit dose product having a blister pack different from the one in FIGS. 1 to 3.

As illustrated in FIG. 4, the same support 10 for a unit dose product can be used for a product P', for example a tablet, contained in a blister pack 14' having a blister 16' shaped substantially as a segment of a sphere. In this case, the blister 16' of the blister pack 14', while protruding from the main opening 20, does not occupy the whole width thereof and, depending on the rigidity of the material of the card 11, and the looser or tighter fastening of the flap 13 to the main portion 12, it can be displaced relatively easily along the main opening 20 if necessary, without however coming out of said opening.

Figure 5:
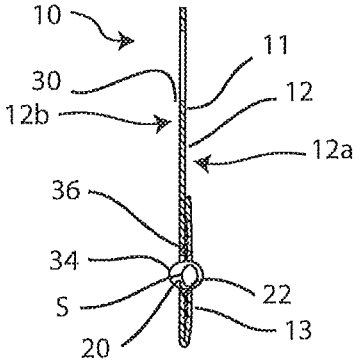
FIG. 5 is a section similar to that in FIG. 2, showing the support in the previous figures, assembled with a unit dose product contained in a different pack.

The provision of a wide secondary opening 22 is advantageous where, as illustrated in FIG. 5, a unit dose product P" is not housed in a blister pack, but in a packet 34 that does not have a flat side but is provided with an end edge 36 that can be held between the main portion 12 of the card 11 and the flap 13. The packet 34, which in a typical but non-restrictive exemplary case can contain a suppository S or other unit dose product, can protrude from both sides of the support 10.

Figure 6:
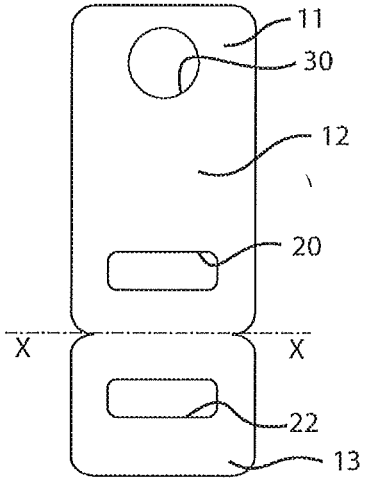
FIG. 6 is a view of a card made of material configured for producing the support for a unit dose product as in FIGS. 1 to 5.

As can be seen in FIG. 6, the support 10 for a unit dose product described above is advantageously produced on the basis of a card 11 made of material that has some degree of flexibility, but is not too yielding or soft. Preferably, the card 11 is a thin sheet of plastics material, but as mentioned above different materials can also be used for the purpose, such as a sheet of cardboard or laminated paper, a slim metal plate or the like. When the support 10 is in its unassembled state, the card 11 has the flap 13 unfolded on the same plane as the main portion 12. The main opening 20 and the secondary opening 22, which in this non-restrictive example are the same shape and size, but which—as will be seen below, can also differ from one another—are made in a symmetrical position relative to the transverse fold line X-X. The transverse fold line X-X can simply be a geometric line, or can be marked on the card 11 by an actual incision or notch or a line of weakening of the material of the card 11, for easier folding, especially in the case of material that is not too thin or is inflexible.

Figure 7A:
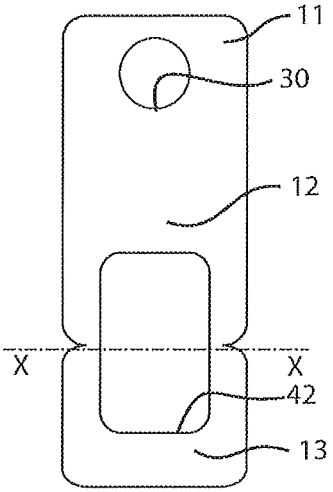
Figure 7B:
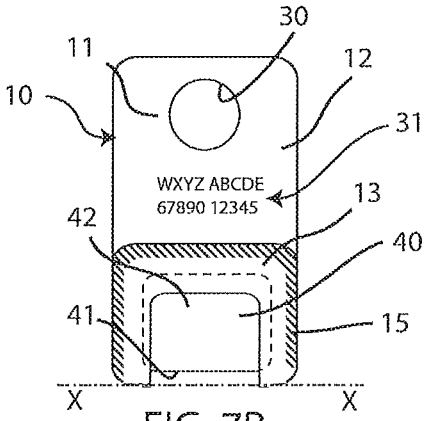

FIGS. 7A and 7B show a variant of the support 10 for a unit dose product, respectively in the configuration of the card 11 before assembly and in the assembled configuration of the support 10. This variant of the support 10 is particularly suitable for a drug or other product packaged in a sachet 40, such as a soluble oral product, a soluble powder, a sterile gauze, etc. To open a pack of this kind it is normally necessary to tear off an end strip thereof. The support 10 can therefore be produced in such a way as to have a single opening or aperture 42 made half on the main portion 12 and the other half on the flap 13 of the card 11. When the flap 13 is folded over and fastened to the main portion 12, the edge of the support 10 corresponding to the fold line X-X is interrupted by the opening 42, leaving one side 41 of the sachet 40 exposed, while the other sides of the sachet are held tight between the flap 13 and the main portion of the card 11. In this case, the weld 15 between the flap 13 and the main portion 12 should be made on just three sides, excluding the edge of the support 10 corresponding to the fold line X-X.

Figure 8A:
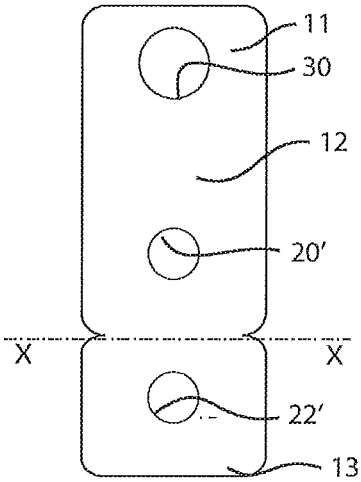
Figure 8B:
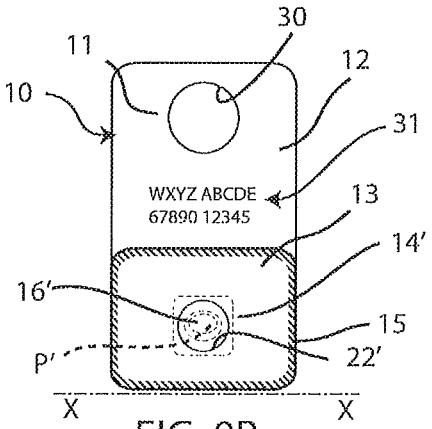

FIGS. 8A and 8B show a variant of the support 10 for a unit dose product, respectively in the configuration of the card 11 before assembly and in the assembled configuration of the support 10. This variant of the support 10 is produced in particular for a product P', for example a tablet, contained in a blister pack 14' having a blister 16' substantially in the shape of a segment of a sphere. In this case, unlike the variant in FIG. 4, the blister 16' of the blister pack 14' is surrounded by the edge of a circular main opening 20'. The secondary opening 22' is also circular with dimensions substantially corresponding to the main opening 20', so as to be superimposed thereon in the assembled configuration of the support 10, illustrated in FIG. 8B, with the flap 13 superimposed on and fastened to the main portion 12 of the card 11. In this case, the weld 15 can be made on all or part of the peripheral contour of the flap 13.

Figure 9A:
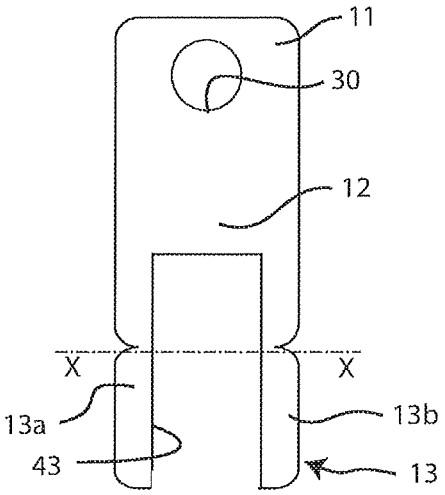
Figure 9B:
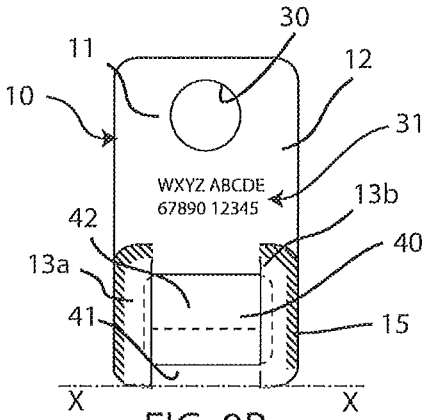

FIGS. 9A and 9B show a variant of the support 10, in which a wide opening 43 is made in the main portion 12 and in the flap 13 of the card 11, which opening extends as far as the end of the flap 13, which end is reduced to two branches 13*a*, 13*b*. In the folded configuration illustrated in FIG. 9B, the two branches 13*a*, 13*b* are folded over the main portion 12 of the card 11, to which they are fastened as described above, for example by welding or gluing in the hatched zones 15 in the figure. The support 10 can be accessed from outside the pack of the drug contained therein, so as to allow—as in the example in FIGS. 7A and 7B—the edge 41 thereof to be torn off in the case where this is a sachet 42.

Figures 10A, 11A, 12A, 13A:
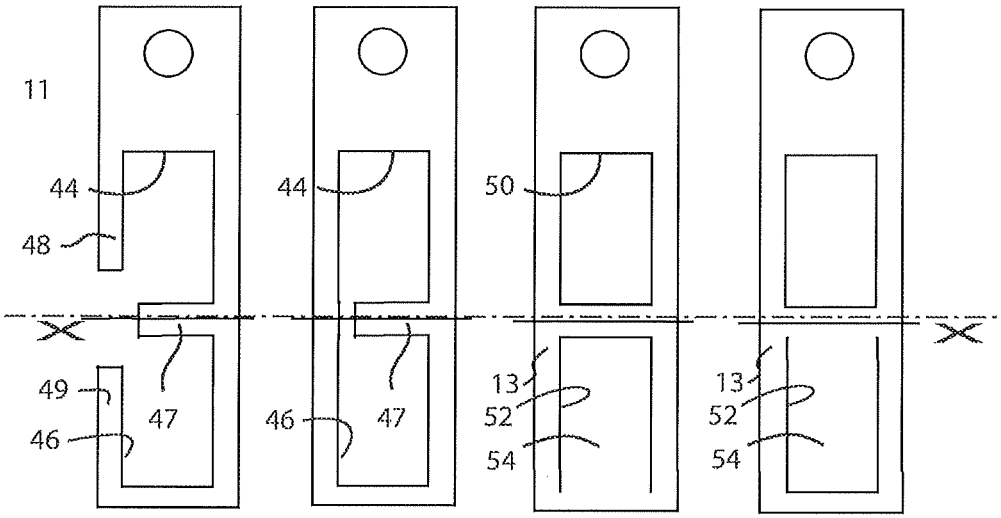

FIGS. 10A; 10B to 13A and 13B show other variants of the card 11, illustrated respectively before and after the flap 13 is folded over the main portion 12. To simplify illustration, no representation has been given of the pack of unit dose product that, when the card 11 is folded, is contained between the flap 13 and the main portion 12 so as to form the support for the unit dose product referred to in the present invention.

Figures 10B, 11B, 12B, 13B:
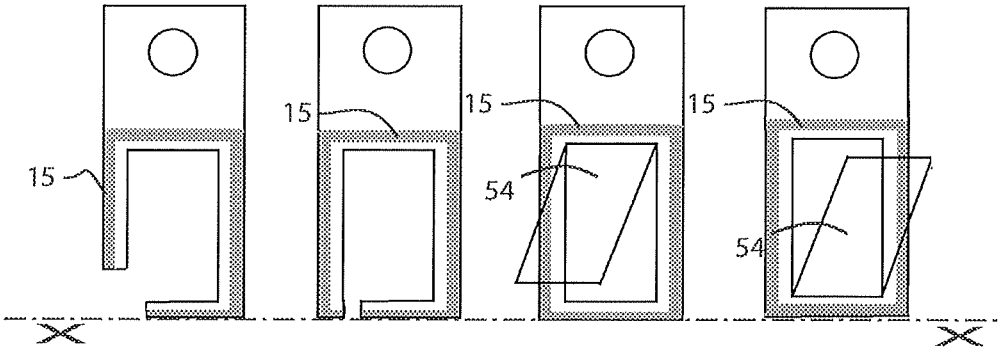

FIGS. 10A and 10B show a variant of the support 10 in which two wide openings 44, 46, which are symmetrical relative to the fold line X-X, are made in the main portion 12 and in the flap 13 of the card 11. A lateral portion of the card 11 is also removed in the area of the fold line X-X, so that the resulting card 11 has a branch 47 at the fold line X-X and two symmetrically facing branches 48, 49 on the main portion and on the flap 13. In the folded configuration illustrated in FIG. 10B, in which the possible weld 15 is shown as hatching, the support 10 can be accessed from outside the pack of the drug contained in the support 10, so as to allow—as in the examples in FIGS. 7A, 7B and 9A and 9B—the edge thereof to be torn off in the case where this is a sachet.

FIGS. 11A and 11B show a configuration of the card 11 similar to that in FIGS. 10A and 10B, in which, however, as well as the wide openings 44, 46, which are symmetrical relative to the fold line X-X, only a small portion of the card 11 that connects said openings 44, 46 is removed in the area of the fold line X-X, thus creating a single branch 47 at the fold line X-X. When the card 11 is in the folded configuration shown in FIG. 11B, this variant leaves a small open segment on the folded edge, which is useful, as in the examples in FIGS. 7A, 7B; 9A, 9B and 10A and 10B, for access to a strip of a sachet that is contained between the flap 13 and the main portion 12.

FIGS. 12A and 12B show a variant of the support 10 in which an opening 50 is made in the main portion 12 and is capable of housing for example the blister of a blister pack for a unit dose product, as already described above with reference to FIGS. 1 to 4. It should be noted that the opening 50 can be of the desired shape and size, for example the opening 22 can be oblong in shape as in FIGS. 1 to 4, or circular in shape as in FIGS. 8A and 8B. The size of the opening 50 is also not restrictive, but can vary depending on the size of the blister of the blister pack of the unit dose product to be connected to the card 11. In this particular variant, rather than a complete opening, simply a notch 52 that will form a tab 54 is made in the flap 13. When the card 11 is folded, as shown in FIG. 12B, the tab 54 can be folded so as to allow the unit dose product to come out when the blister of the blister pack is squeezed. In this variant, the film that seals the blister of the blister pack is more protective than in the variants illustrated previously, which provide an actual opening in the flap 13 of the card 11.

FIGS. 13A and 13B show a variant of the support 10 referred to in FIGS. 12A and 12B, but in which the tab 54' can bend in the opposite direction because of a notch 52' made in a different manner.

Naturally, the notches 52, 52' illustrated in the previous figures by way of example can be made in the flap 13 by different methods and having different shapes. For example, a cross-shaped notch could be made, which is substantially centred—when the card 11 is in the folded configuration— so as to have the centre of the opening made in the main portion. Partial notches, or pre-cuts, could then be made so that the material of the flap 13 corresponding thereto could be broken just by applying pressure to make the unit dose product come out of the blister pack connected to the card 11 of the support 10.

Production of the support for a unit dose product according to the invention can easily be automated, and carried out by means of an industrial plant that provides high productivity and is flexible in relation to the shape of the unit dose products that enter it.

Figure 14:
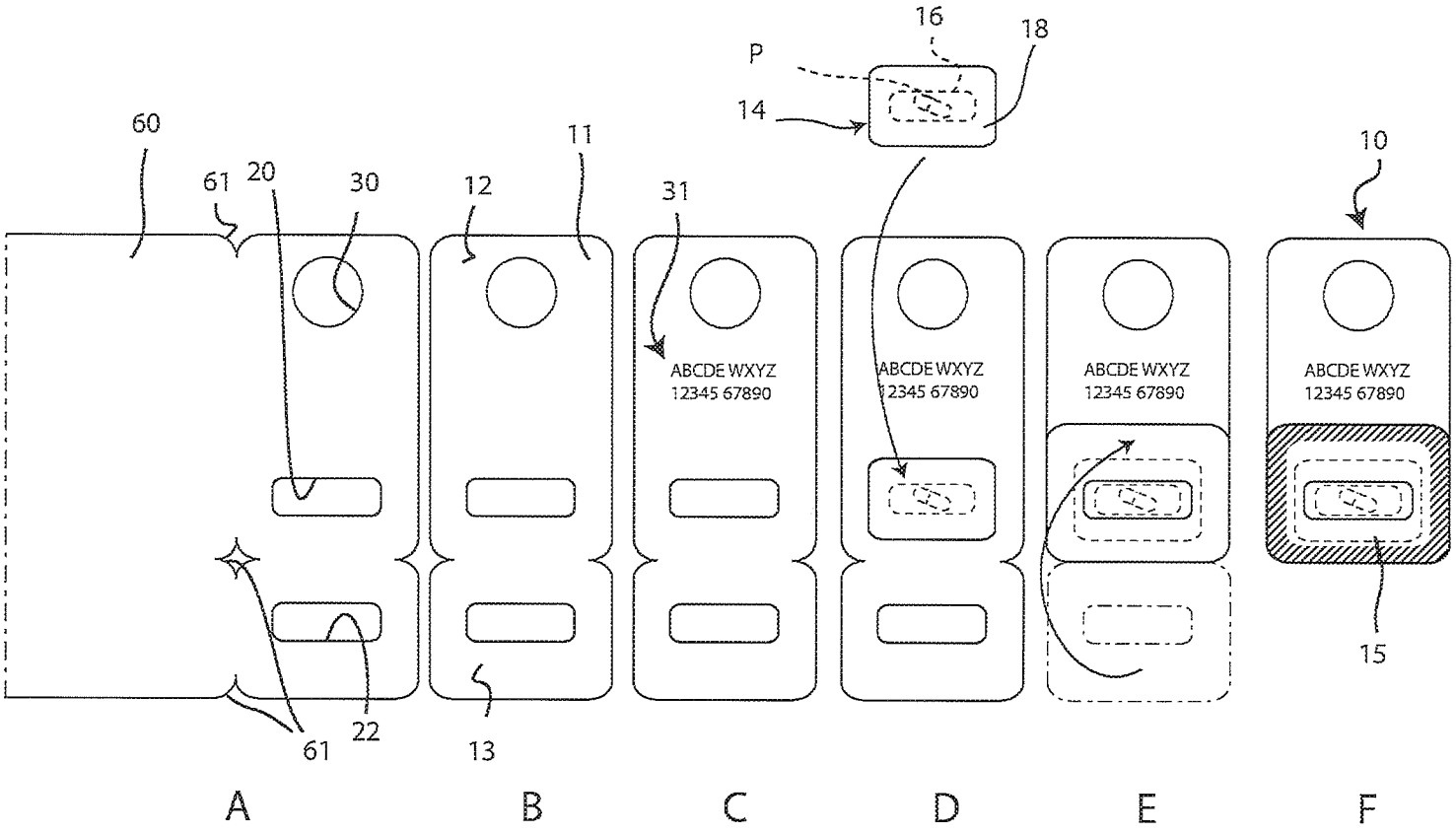
FIG. 14 is a diagrammatic view of the steps of producing and assembling a support for unit dose products according to the invention.

FIG. 14 diagrammatically shows the steps of producing a support 10 for a unit dose of the type described above.

In a first step A, a band 60 of material from which the card 11 is made is cut to produce the desired openings therein. In the example in FIG. 14, the openings 20, 22 of the support example described previously, and the hole 30, are made in the band 60. Other kinds of cutting and shearing 61 can also be done to give the card 11 the desired final shape. Subsequently, in step B, the band 60 is cut transversely to produce the individual strips 11. Preferably, the strips 11 are made in the transverse direction of the band 60, so that the flaps 13 are turned to face one side of the band 60 (at the bottom in FIG. 13) and are thus accessible to a folding tool without it being necessary to move the strips 11 apart, or excessively apart, from one another. The information 31 is then put on each card 11 produced from the band 60. A blister pack 14 for a unit dose product P is then connected to the card 11, inserting the blister 16 into the main opening 20 made in the main portion of the card 11. Preferably, the unit dose product is connected to the card 11 immediately after or immediately before the information is added on the card 11, to avoid errors. Next, the flap 13 is folded over the main portion 12 of the card 11. The next step involves welding or gluing the flap 13 onto the main portion 12 along the zone 15. The support 10 for a unit dose product P is then complete and ready for the subsequent handling thereof.

Naturally, without prejudice to the principle of the invention, the embodiments and the implementation details can vary greatly from what is described and illustrated, while remaining within the scope of the present invention.

The invention claimed is:

1. A support for a product packaged as only a single unit dose, comprising a single unit pharmaceutical dose product, and a plastic support card comprising a main portion and a flap folded over and fastened to the main portion to thereby provide the support card with a single layer area comprising only a single layer of the main portion and an overlap area comprising layers of both the main portion and the flap, the overlap area being smaller than the single layer area, the main portion including a main opening in the overlap area and a hanging opening in the single layer area, the flap being welded to the main portion only along three peripheral edges of the flap with no added material to affect connection of the flap to the main portion, the support further including a blister pack comprising a protruding blister on a first side of the blister pack and a flat surface on a second side thereof opposite the first side, with the blister pack being enclosed between the flap and the main portion of the support card, the blister protruding through the main opening such that only the blister protruding from the main opening extends from the support card, the blister pack having the single unit pharmaceutical dose product therein, and a secondary opening in the flap to allow the single unit pharmaceutical dose product to be removed from the blister pack.

2. The support for the product according to claim 1, wherein the secondary opening in the flap is the same size as the main opening in the main portion of the support card.

3. The support for the product according to claim 1, wherein the main opening is a elongated slot in the support card.

4. The support for the product according to claim 1, wherein the main opening is a circular hole.

5. The support for the product according to claim 1, wherein the main opening extends into the flap.

6. The support for the product according to claim 1, wherein the support card is substantially rectangular, the flap being folded over the main portion along a fold line that is substantially transverse to a long side of the support card.

7. The support for the product according to claim 1, wherein the blister pack is a closed pack encompassing the single unit pharmaceutical dose product therein.

8. A support for a product packaged as only a single unit dose, comprising a single unit pharmaceutical dose product, and a plastic support card comprising a main portion and a flap folded over and fastened to the main portion to thereby provide the support card with a single layer area comprising only a single layer of the main portion and an overlap area comprising layers of both the main portion and the flap, the overlap area being smaller than the single layer area, the main portion including a main opening in the overlap area and a hanging opening in the single layer area, the flap being welded to the main portion only along three peripheral edges of the flap with no added material to affect connection of the flap to the main portion, the support further including a blister pack comprising a protruding blister on a first side of the blister pack and a flat surface on a second side thereof opposite the first side, with the blister pack being enclosed between the flap and the main portion of the support card, the blister protruding through the main opening such that only the blister protruding from the main opening extends from the support card, the blister pack having the single unit pharmaceutical dose product therein, and a notch or a pre-cut incision being made in the flap for opening a portion of the flap and allowing the single unit pharmaceutical dose product to be removed from the blister pack.

9. The support for the product according to claim 8, wherein the support card is substantially rectangular, the flap being folded over the main portion along a fold line that is substantially transverse to a long side of the support card.

10. The support for the product according to claim 8, wherein the blister pack is a closed pack encompassing the single unit pharmaceutical dose product therein.

* * * * *